US012605580B2

(12) United States Patent
Johnson

(10) Patent No.: US 12,605,580 B2
(45) Date of Patent: Apr. 21, 2026

(54) PYRAMID SHAPED PLAYGROUND CLIMBING APPARATUS

(71) Applicant: Quinn Kota Johnson, Brighton, MI (US)

(72) Inventor: Quinn Kota Johnson, Brighton, MI (US)

( * ) Notice: Subject to any disclaimer, the term of this patent is extended or adjusted under 35 U.S.C. 154(b) by 0 days.

(21) Appl. No.: 18/479,090

(22) Filed: Oct. 1, 2023

(65) Prior Publication Data

US 2025/0073517 A1 Mar. 6, 2025

Related U.S. Application Data

(60) Provisional application No. 63/378,097, filed on Oct. 3, 2022.

(51) Int. Cl.
*A63B 9/00* (2006.01)

(52) U.S. Cl.
CPC ..... *A63B 9/00* (2013.01); *A63B 2009/006* (2013.01)

(58) Field of Classification Search
CPC ..... A63B 9/00; A63B 2009/006; A63B 2009/004; A63B 17/00–04; A63B 69/0048; A63B 2208/12
See application file for complete search history.

(56) References Cited

U.S. PATENT DOCUMENTS

| | | | | |
|---|---|---|---|---|
| 3,008,711 | A * | 11/1961 | Dillon | A63B 9/00 D21/826 |
| 3,472,509 | A * | 10/1969 | Flynn | A63B 17/00 182/172 |
| 5,334,098 | A * | 8/1994 | Pope | A63B 9/00 482/35 |
| 6,174,266 | B1 * | 1/2001 | Merrill | A63B 9/00 248/431 |
| 9,132,330 | B2 * | 9/2015 | Brendle | A63B 69/0048 |
| 11,305,168 | B2 * | 4/2022 | Smith | A63B 9/00 |
| 11,992,740 | B2 * | 5/2024 | Smith | A63B 69/0048 |
| 2021/0402240 | A1 * | 12/2021 | Barr | A63G 21/02 |

FOREIGN PATENT DOCUMENTS

| | | | | |
|---|---|---|---|---|
| DE | 202008002562 | U1 * | 7/2008 | A63B 69/0048 |
| FR | 2727034 | A1 * | 5/1996 | A63B 9/00 |

* cited by examiner

*Primary Examiner* — Megan Anderson
*Assistant Examiner* — Kathleen M Fisk
(74) *Attorney, Agent, or Firm* — Woodard, Emhardt, Henry, Reeves & Wagner, LLP

(57) ABSTRACT

A piece of playground equipment, such as a climbing device is provided which includes one or more sides. The playground equipment defines a pyramidal shape with a closed point extending downward to an open rectangular base. Each side includes a different interactive component, such as climbing holds, climbing rope, vine climbers, protrusions, and/or other interactive components. In one version, the playground equipment includes three (3) sides each including a support surface and one (1) side including an opening, without a support surface.

12 Claims, 8 Drawing Sheets

PYRAMID SHAPED PLAYGROUND CLIMBING APPARATUS

CROSS-REFERENCE TO RELATED PROVISIONAL APPLICATION

This nonprovisional patent application claims the benefit of priority to U.S. Provisional Patent Application No. 63/378,097, filed on Oct. 3, 2022, and titled "PYRAMID SHAPED PLAYGROUND CLIMBING APPARATUS." The entire disclosure of U.S. Provisional Patent Application No. 63/378,097 is hereby incorporated by reference in its entirety.

FIELD OF THE INVENTION

The present invention herein pertains to playground equipment and particularly pertains to playground equipment with one or more sides each side having different interactive components from one another.

BACKGROUND OF THE INVENTION

Playground equipment, such as jungle gyms and/or other styles of playground equipment, typically include only a single interactive component, such as a climbing wall. As should be appreciated, children quickly become bored with only a single type and/or style of equipment which results in the purchase of further equipment to maintain the interest of the child. As a result, playground equipment and maintenance costs are increased.

Thus, there is a need for improvement in this field.

SUMMARY

A unique climbing device has been developed to maintain the interest of a child and/or user. The climbing device includes a frame defining a pyramidal shape. The frame originates at a closed point and extends downward and outward to a rectangular base. As a result, the climbing device has a pyramid shape with four (4) sides.

In one embodiment, the climbing device include three (3) sides with support surfaces made from horizontally oriented planks. The support surfaces are configured to support a variety of interactive components, such as ropes, climbing holds, and/or other components to facilitate play and/or climbing. The remaining side does not include a support surface, instead, the remaining side includes an opening defined by the frame. The opening includes an interactive component, such as vine climbers extending across the opening and secured to the frame. As should be appreciated, each side includes a different interactive component from the other sides. Thus, the interest of a child and/or user is maintained.

Further forms, objects, features, aspects, benefits, advantages, and embodiments of the present invention will become apparent from a detailed description and drawings provided herewith.

DETAILED DESCRIPTION OF THE SELECTED EMBODIMENTS

Figure 1:
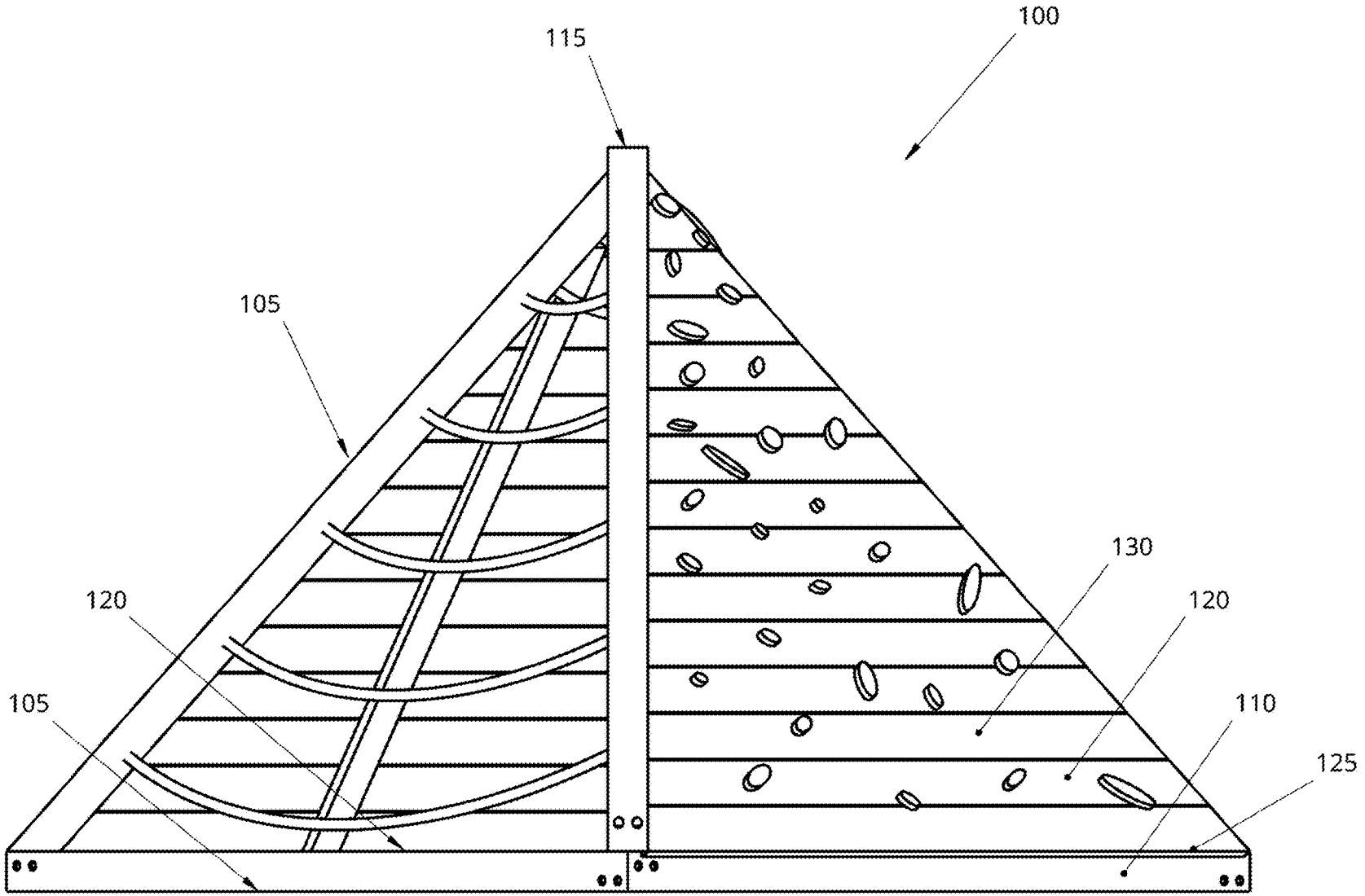
FIG. 1 is a perspective view of a climbing device according to one embodiment of the present invention.

For the purposes of promoting and understanding of the principles of the invention, reference will now be made to the embodiment illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "climbing device 100" series reference numeral will likely first appear in FIG. 1, an element identified by a "200" series reference numeral will likely first appear in FIG. 2, and so on.

FIG. 1 shows an example of a climbing device 100. In the illustrated example, the climbing device 100 is an entertainment device for individuals, such as children to climb, play, and/or otherwise use recreationally. For example, the climbing device 100 may be used in playgrounds, parks, backyards, and/or other locations. The climbing device 100 includes a frame 105 defining a pyramidal shape. The frame 105 extends from a rectangular base 110 to a point 115. As should be appreciated, the pyramidal shape of the frame 105 gives the climbing device 100 an overall pyramid shape. As a result, the climbing device 100 includes four (4) sides 120 defining substantially triangular shapes. The sides 120 extend upward from the base 110 to the point 115, where each of the sides 120 meet and/or originate. In the illustrated embodiment, the frame 105 originates at the point 115 and slopes outward from the point 115 to the base 110. Depending on the ratio of base size to climbing device height, the sides 120 may have different slopes. For example, a smaller base 110 (e.g. smaller length and/or width) typically defines a steeper slope, whereas a larger base 110 (e.g. larger length and/or width) typically defines a slope that is less steep.

In the illustrated embodiment, the three (3) of the four (4) total sides 120 include a series of horizontally arranged planks 125 defining support surfaces 130. The support surfaces 130 are configured to support one or more interactive components, such as ropes, climbing holds, and/or other components mounted on the support surfaces 130. In the illustrated embodiment, one (1) of the four (4) sides 120 does not include a support surface 130. Instead, the side 120 includes an opening 135 defines by the frame 105. As should be appreciated, the climbing device 100 may include an alternate number of sides 120 with and/or without support surfaces 130 and/or openings 135. For example, the climbing device 100 may include two (2) sides with support surfaces 130 and two (2) sides with openings 135. In another example, the climbing device 100 may include four (4) sides with support surfaces 130 and zero (0) sides with openings 135.

Figure 2:
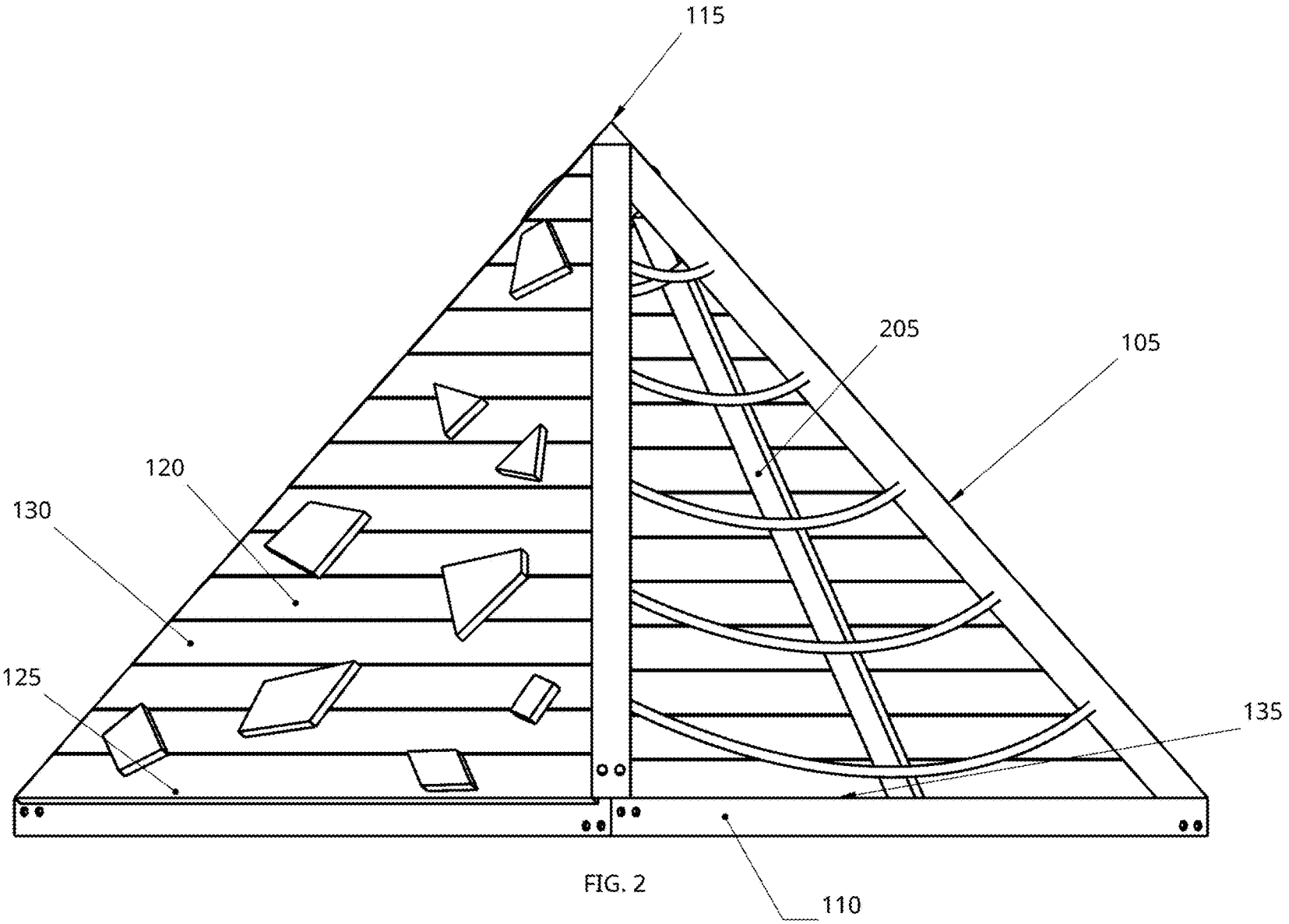
FIG. 2 is a perspective view of the climbing device of FIG. 1.

Turning to FIG. 2, the climbing device 100 includes one or more braces 205 arranged within an interior portion of the device. The braces 205 are configured to support the planks 125 defining the support surface 130. The braces 205 extend from the point 115 to a midpoint of the base 110. The braces 205 mitigate bowing and/or breaking of the planks 125 during use.

Figure 3:
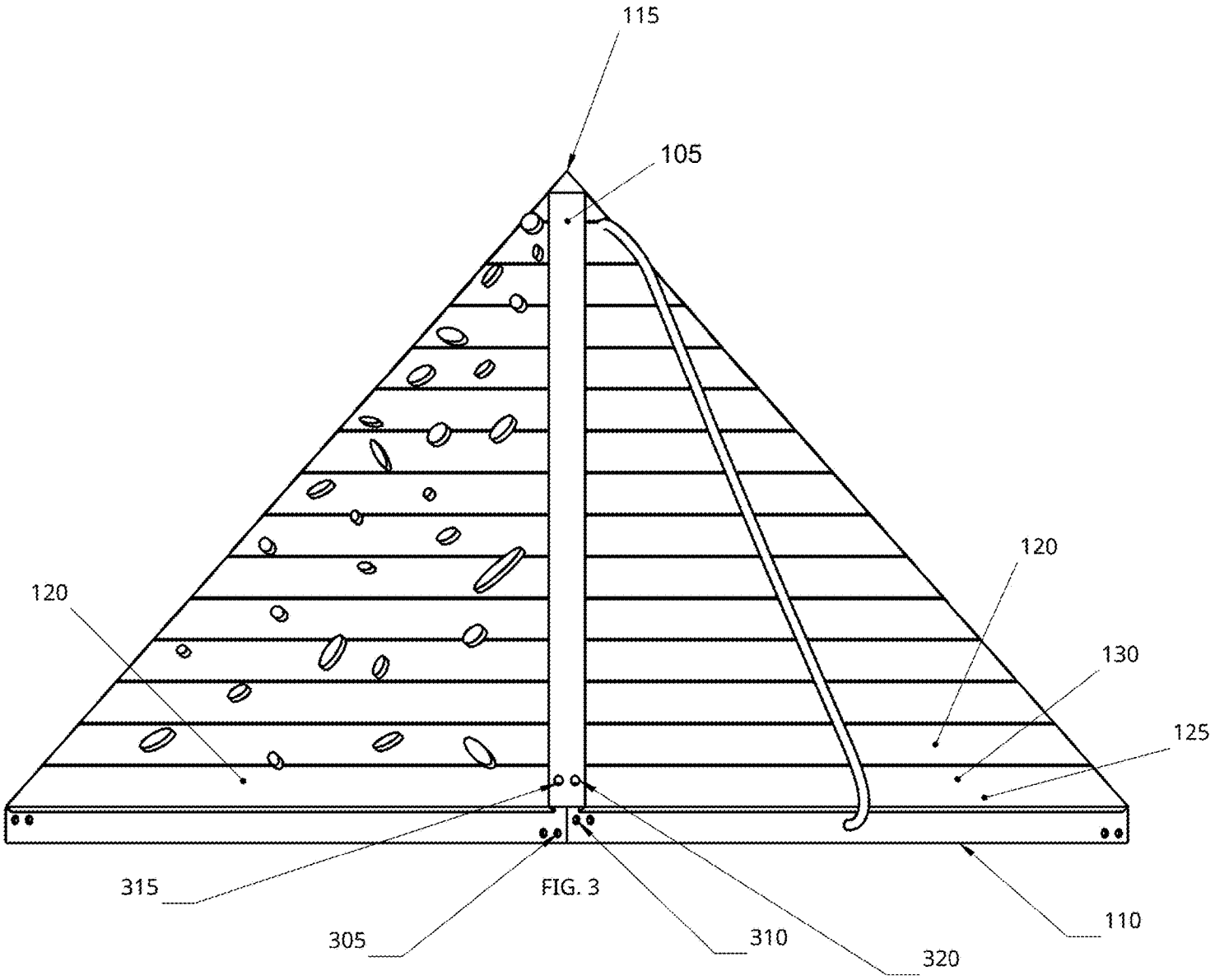
FIG. 3 is a perspective view of the climbing device of FIG. 1.

As illustrated in FIG. 3, the base 110 of the climbing device 100 is held together via one or more fasteners 305 configured to engage with one or more apertures 310. Similarly, the frame 105 of the climbing device 100 is secured to the base 110 via one or more fasteners 315 configured to engage with one or more apertures 320. In the illustrated embodiment, the frame 105 of the climbing device 100 is made from wood. In alternate embodiments, the frame of the climbing device is made from metal, plastic, and/or a combination of materials.

Figure 4:
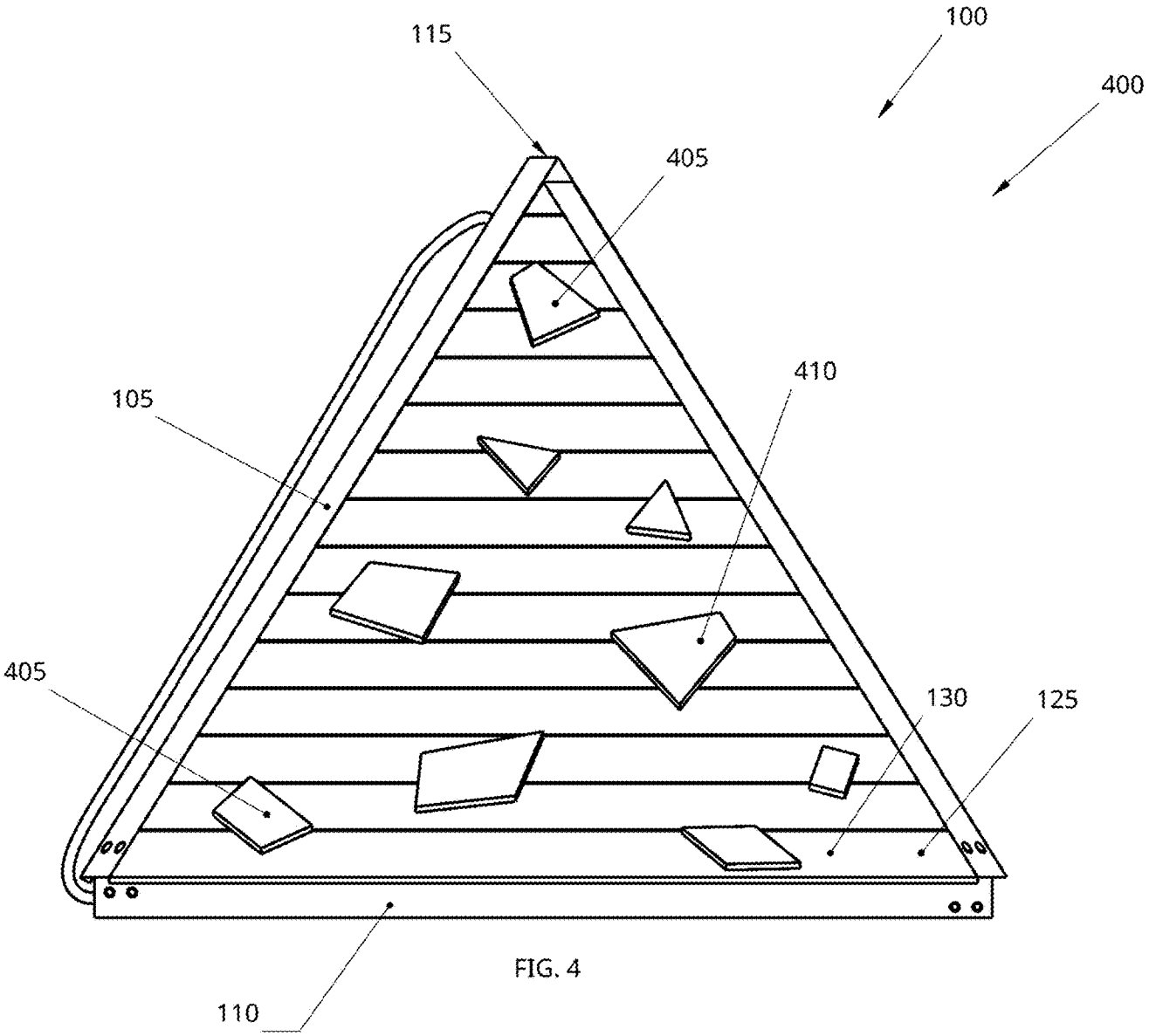
FIG. 4 is a side view of a first side of the climbing device of FIG. 1.

Looking at FIG. 4, a first side 400 of the climbing device 100 includes one or more interactive components 405 mounted on the support surface 130. In the illustrated example, the first side 400 includes interactive components 405 in the form of one or more protrusions 410. In one example, the protrusions 410 are used by children and/or adults for climbing and/or other activities. In other versions, the interactive components 405 may be different.

Figure 5:
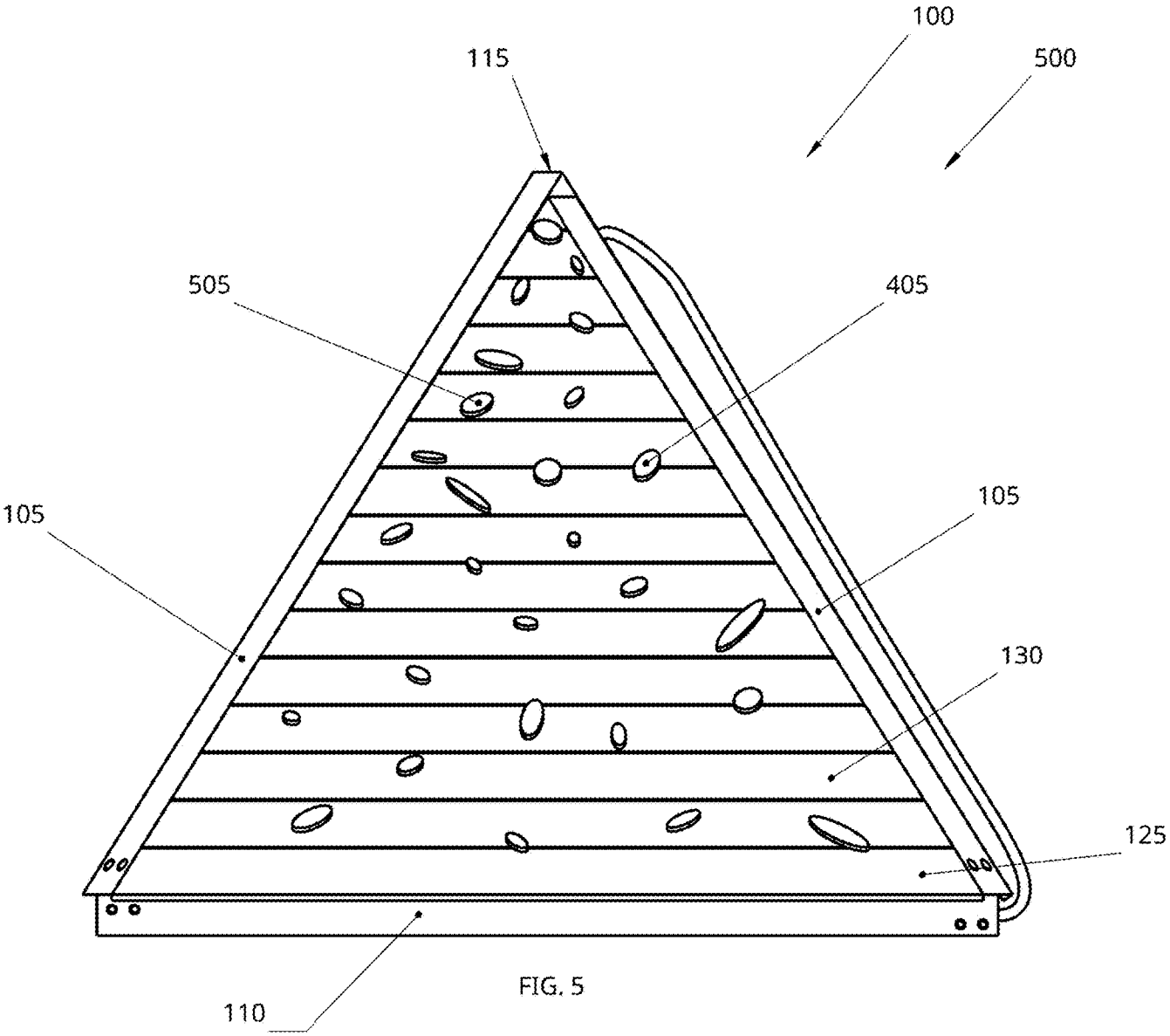
FIG. 5 is a side view of a second side of the climbing device of FIG. 1.

Illustrated in FIG. 5 is a second side 500 of the climbing device 100. The second side 500 includes a support surface 130 with different interactive components 405 from the first side 400, such that the first side 400 and the second side 500 are different. For example, the second side 500 includes one or more climbing holds 505 distributed across the support surface 130, such as to mimic a climbing wall. In another version, the second side 500 may include the same interactive components 405 as the first side 400, such that first side 400 and the second side 500 are the same.

Figure 6:
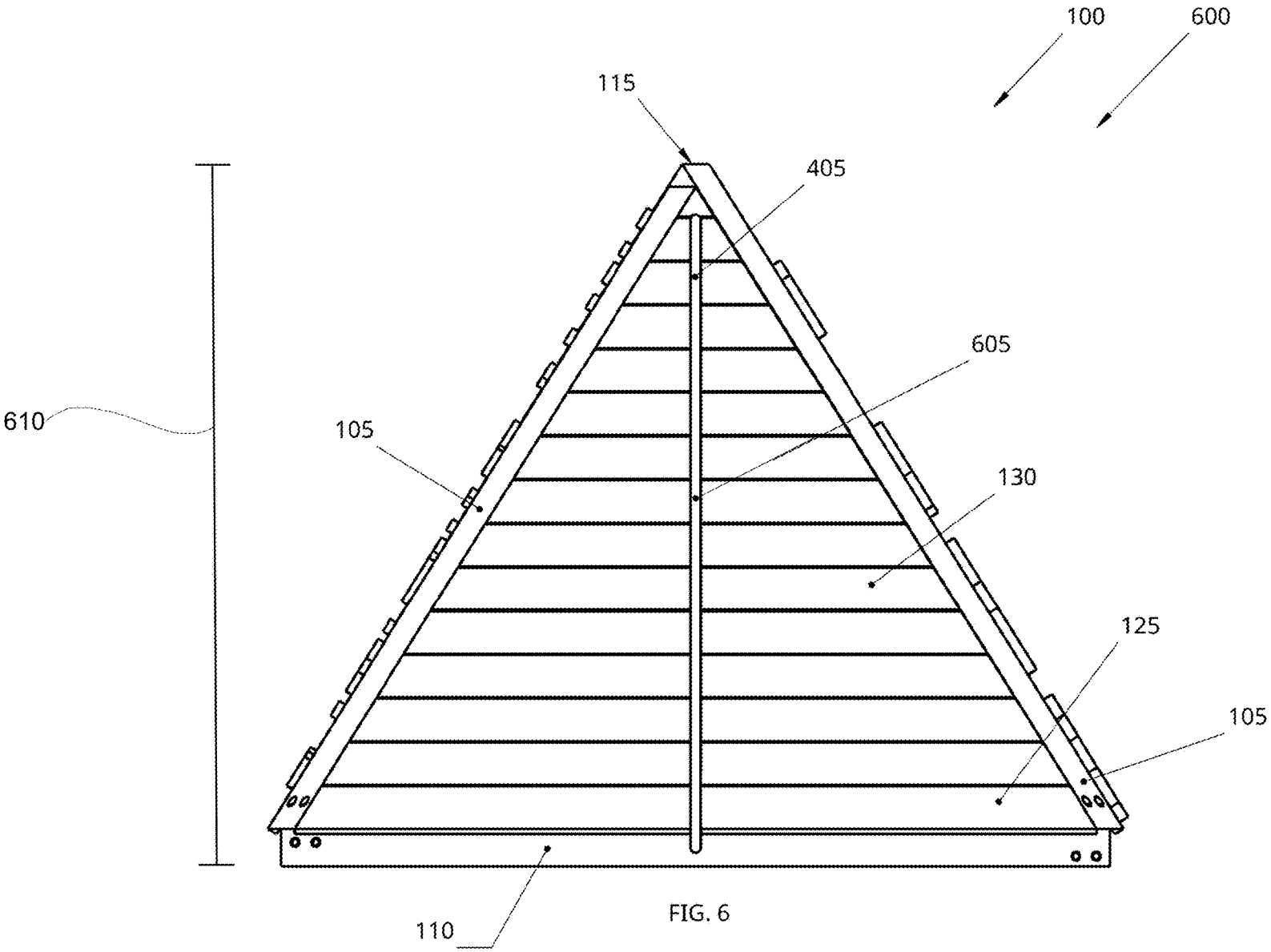
FIG. 6 is a side view of a third side of the climbing device of FIG. 1.

FIG. 6 shows an example of a third side 600 of the climbing device 100. The third side 600 includes a support surface 130 with a different interactive component 405 from the first side 400 and the second side 500. Put differently, the first side 400, second side 500, and third side 600 are all distinct and/or different from each other. For example, the third side 600 includes a rope 605. The rope 605 is typically secured with one end adjacent the base 110 and with another end adjacent the point 115, such that the rope 605 includes a length relative to a height 610 of the climbing device 100. As should be appreciated, the height 610 of the climbing device 100 is measured from the base 110 to the point 115 of the climbing device 100. In another version, the third side 600 may include the same interactive components 405 as the first side 400 and the second side 500, such that all three (3) sides are the same. In yet another version, the third side 600 may include the same interactive components 405 as the second side 500, but different interactive components 405 from the first side 400 and vice versa, such that two (2) of the sides are the same, while one (1) side is different.

Figure 7:
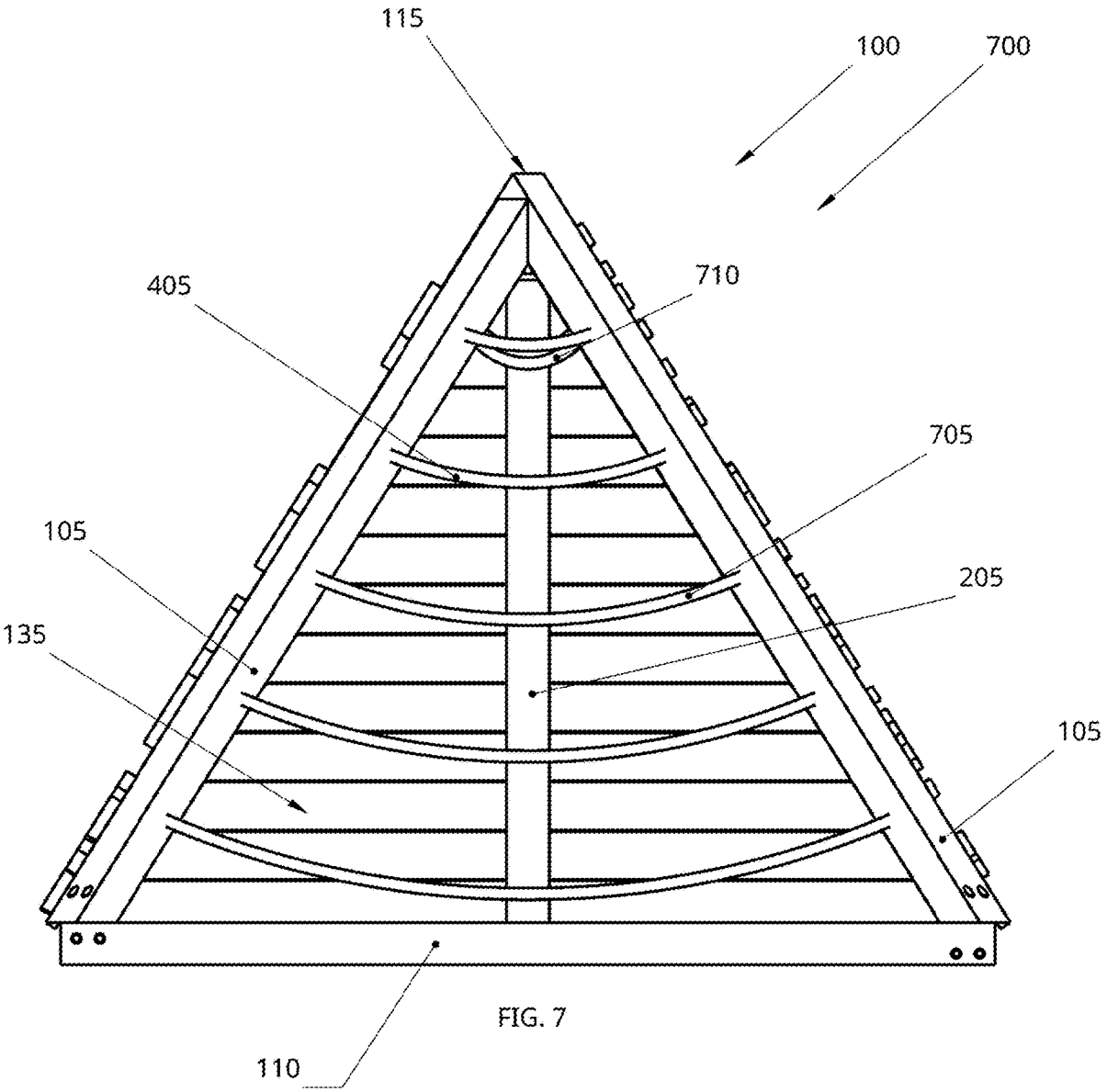
FIG. 7 is a side view of a fourth side of the climbing device of FIG. 1.

A fourth side 700 of the climbing device 100 is illustrated in FIG. 7. The fourth side 700 includes the opening 135 defined by the frame 105 of the climbing device 100. In the illustrated embodiment, the fourth side 700 includes different interactive components 405 from the first side 400, second side 500, and third side 600. For example, the fourth side 700 includes one or more horizontally oriented vine climbers 705.

In another version, the fourth side 700 includes a support surface 130 with the same interactive components 405 as the first side 400, second side 500, and third side 600, such that all four (4) sides are the same. In another version, the fourth side 700 includes a support surface 130 with the same interactive components 405 as the second side 500, but different interactive components 405 from the first side 400 and third side 600.

As should be appreciated, the climbing device 100 is configured as a modular system. For example, the interactive components 405 of the sides 120 may be interchanged as desired to update and/or refresh the climbing device 100. In another example, the sides 120 may be altered to remove one or more support surfaces 130, such as to replace the support surfaces 130 with one or more openings 135. In yet another example, the sides 120 may be altered to add one or more support surfaces 130, such as to replace one or more openings 135.

Figure 8:
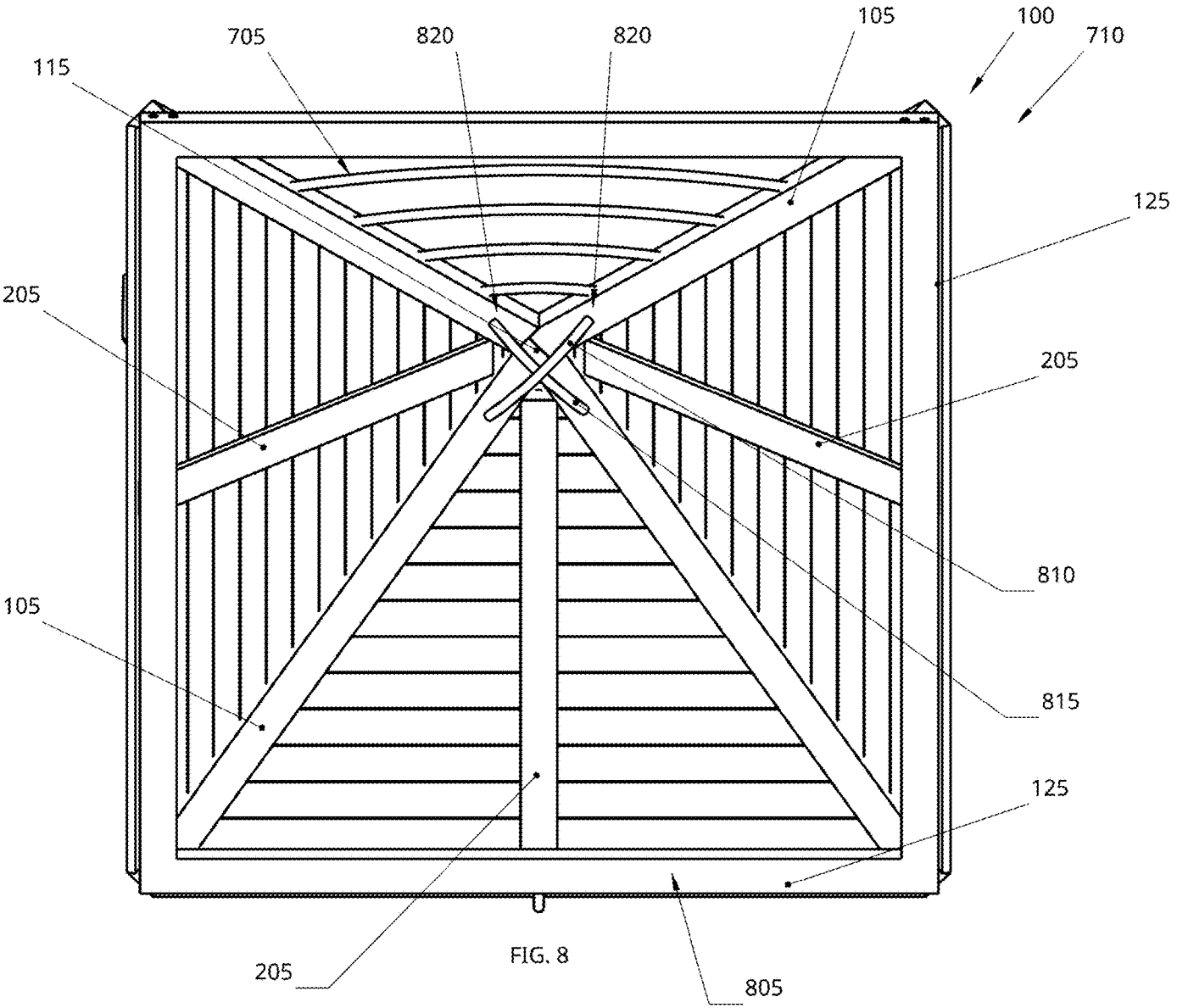
FIG. 8 is a bottom perspective view of a support system of the climbing device of FIG. 1.

As illustrated in FIG. 8, an interior portion 805 of the climbing device 100 includes a cable system 710. The cable system 710 is configured to provide another interactive component 405 for user to play with. For example, the cable system 710 may be used for pull ups, hanging exercises, and/or other climbing games/activities. In the illustrated example, the cable system 710 includes a first cable 810 and a second cable 815 forming an X-shaped structure. In one version, the first cable 810 and the second cable 815 are in the form of chains, braided metal cable, and/or ropes secured to the frame 105 via one or more fasteners 820. In another version, the cable system 710 is configured to mitigate gapping and/or separation of the sides 120 at the point 115. As should be appreciated, the cable system 710 may be arranged to provide additional structural support to the climbing device 100 via the first cable 810 and the second cable 815.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Fastener" generally refers to a hardware device that mechanically joins or otherwise affixes two or more objects together. By way of non-limiting examples, the fastener can include bolts, dowels, nails, nuts, pegs, pins, rivets, screws, buttons, hook and loop fasteners, and snap fasteners, to just name a few.

"Frame" generally refers to a structure that forms part of an object and gives strength and/or shape to the object.

"Horizontal" generally refers to a plane and/or direction, which is parallel with the plane of the horizon. In another example, the horizontal plane and/or direction is at a right angle to a vertical plane or direction. An item that moves in the sideways (left to right) direction is generally said to move horizontally. For example, a lever fixed on one end to a rod that is able to move to the left and right is said to move horizontally. In yet another example, the slope of a horizontal line is 0.

"Mounted" means physically attached to or held in place by. This may be by fasteners, adhesives, conduits, brackets, over molded plastic, or otherwise.

"Support Surface" generally refers to any type of surface on which another object may rest, be coupled to, be attached to, or come into contact with. A support surface may be flat or curved, may be the top, bottom, or any side of an object, or may be the ground.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the inventions as described herein and/or by the following claims are desired to be protected.

Hence, the proper scope of the present invention should be determined only by the broadest interpretation of the appended claims so as to encompass all such modifications as well as all relationships equivalent to those illustrated in the drawings and described in the specification.

The invention claimed is:

1. A climbing device comprising:

a frame defining a pyramidal shape, originating at a closed point and extending downward and outward to a rectangular base, wherein the frame comprises four sides;

three of the four sides having support surfaces formed by horizontally oriented planks, wherein each support surface is configured to support interactive components;

the fourth side lacking a support surface and including an opening defined by the frame, wherein the opening corresponds to an entire area of the fourth side between the frame, and wherein the opening is configured to accommodate an interactive component, and wherein the opening is configured to provide access into an interior portion of the frame;

a first cable extending between two non-adjacent sides of the frame;

a second cable extending between the other two non-adjacent sides of the frame;

wherein the first cable and the second cable cross to form an X-shaped configuration within the interior portion of the frame; and wherein the first cable and the second cable are positioned nearer the closed point of the frame than the rectangular base.

2. The climbing device of claim 1, further comprising one or more braces arranged within the frame, wherein each of the one or more braces is configured to support a respective one of the support surfaces.

3. The climbing device of claim 2, wherein the one or more braces extend between the rectangular base and the closed point.

4. The climbing device of claim 2, wherein the fourth side lacks a brace.

5. The climbing device of claim 1, wherein the interactive components include climbing holds secured to the support surfaces of the three sides.

6. The climbing device of claim 1, wherein the interactive component on the fourth side comprises vine climbers extending across the opening and secured to the frame.

7. The climbing device of claim 1, wherein the closed point is situated at a topmost portion of the frame and the rectangular base forms a lowermost portion of the frame.

8. The climbing device of claim 1, wherein the climbing device is modular, allowing interchangeability of interactive components between one or more of the sides.

9. The climbing device of claim 1, wherein the opening defined in the fourth side is in the shape of a triangle.

10. The climbing device of claim 1, wherein at least one of the interactive components on the three of the four sides having support surfaces is a climbing hold.

11. The climbing device of claim 1, wherein at least one of the interactive components on the three of the four sides having support surfaces is a rope.

12. The climbing device of claim 1, wherein at least one of the interactive components on the three of the four sides having support surfaces is a protrusion.

* * * * *